United States Patent [19]

Rund

[11] 3,968,776

[45] July 13, 1976

[54] ROTARY CRANKLESS MACHINE

[75] Inventor: Larry D. Rund, Marshall, Minn.

[73] Assignee: Rund Rotary Engines, Inc., Marshall, Minn.

[22] Filed: Aug. 23, 1974

[21] Appl. No.: 500,013

[52] U.S. Cl. ..... 123/43 C; 123/43 A; 92/56

[51] Int. Cl.[2] ..... F02B 53/08

[58] Field of Search ..... 123/43 AA, 43 A, 43 C, 123/44 E; 92/54, 56, 57, 58

[56] References Cited

UNITED STATES PATENTS

| | | | |
|---|---|---|---|
| 1,255,664 | 2/1918 | Syger | 123/43 AA |
| 1,332,756 | 3/1920 | Root | 123/43 A |
| 1,604,474 | 10/1926 | Nisbet | 123/43 AA |
| 1,857,000 | 5/1932 | Kleschka | 123/43 A |
| 1,987,699 | 1/1935 | Moore | 123/43 AA |
| 3,807,370 | 4/1974 | Baugh | 123/43 C |

FOREIGN PATENTS OR APPLICATIONS

| | | | |
|---|---|---|---|
| 121,656 | 1/1919 | United Kingdom | 123/43 A |

*Primary Examiner*—Clarence R. Gordon
*Attorney, Agent, or Firm*—Frederick E. Lange

[57] ABSTRACT

A rotary crankless machine in which there is a rotary shaft, a rotary cylinder block, and a stationary housing, all concentrically disposed about a common axis and in which the housing has a central annular manifold block with inlet and outlet passages disposed midway between the ends of the housing. The rotary cylindrical block and shaft are rotatably coupled together and the rotary cylindrical block has a pair of sets of inwardly directed cylinders each of which extends from adjacent the outer wall of the cylinder block inwardly towards the manifold block and disposed so as to be selectively in communication with the inlet and outlet passages of the manifold block as the cylinder block rotates, and in each of which a piston is reciprocated. The longitudinal axis of each cylinder is substantially inclined inwardly with respect to the common axis of the machine and with respect to the transverse plane perpendicular to the axis. Cam means is disposed about the stationary housing in association with each of the pistons to cause reciprocation of the pistons to accompany rotation of the rotary cylinder block and thus rotation of the rotary shaft. Specifically, the machine takes the form of an internal combustion engine having igniting means, such as a spark plug, disposed in the central manifold block between the inlet and outlet passages. In such case, the inlet passage becomes a fuel admission port and the outlet passage an exhaust passage for burned gasses.

9 Claims, 5 Drawing Figures

ROTARY CRANKLESS MACHINE

BACKGROUND OF THE INVENTION

The present invention pertains to rotary crankless machines of the type in which there is no crank shaft and in which the pistons are connected to a rotary shaft through cam means in such a manner that reciprocation of the pistons results in rotary movement of the shaft or vice versa. A number of devices of this general type are known in the art. All have the advantage that they tend to result in less vibration in a typical crank shaft type of reciprocating machine.

The problem with devices of this general type, however, is that it is difficult to provide a balanced mechanism which operates with relatively low frictional noise and is relatively compact.

SUMMARY OF THE INVENTION

The present invention is concerned with a rotary crankless machine in which there is a rotary shaft, a rotary cylinder block and a stationary housing all concentrically disposed about a common axis and in which the housing has a central annular manifold block with inlet and outlet passages, this manifold block being located midway between the ends of the housing. The rotary cylinder housing and shaft are rotatably coupled together and the rotary cylindrical housing has a pair of sets of inwardly directed cylinders which extend inwardly towards the manifold block and are disposed so as to be selectively in communication with the inlet and outlet passages of the manifold block as the cylinder block rotates. The cylinders are preferably inclined inwardly with respect to the common axis.

In order to interconnect the pistons and the rotary shaft so that reciprocation of the pistons and rotation of the shaft accompany each other, the stationary housing is provided with cam grooves and each piston is provided with a cam follower which cooperates with one of the cam grooves so that rotation of the shaft and reciprocation of the pistons necessarily accompany each other.

The machine is specifically adapted for use in the engine field, the inlet and outlet passages in that case constituting inlet and outlet passages for motive fluid. Where the engine is of the internal combustion type, suitable igniting means such as a spark plug is provided between the inlet and outlet passages.

Due to the fact that the cylinders are in two sets the inner ends of which face each other, they both can communicate with the central manifold resulting in a minimum of manifold passages. Furthermore, because of the symmetrical nature of the engine, it is well balanced and relatively free from vibration.

Because the cylinders are inclined inwardly, the mechanism is quite compact longitudinally. Furthermore, the angular inclination results in a better transfer of motion between the rotary cylinder housing and the shaft. In addition, because the angle of inclination is in the direction of rotation, whatever reactive effect there is between the combustion chamber and the manifold block tends to cause relative rotation of the rotary cylinder block and the stationary housing. Furthermore, since the thrust exerted by the pistons is always at an angle with respect to both the longitudinal axis and a plane transverse to the longitudinal axis, vibration of the apparatus is minimized.

Various other advantages of the invention will be apparent from a consideration of the accompanying specification, claims and drawings.

DESCRIPTION OF THE PREFERRED EMBODIMENT

Figure 2:
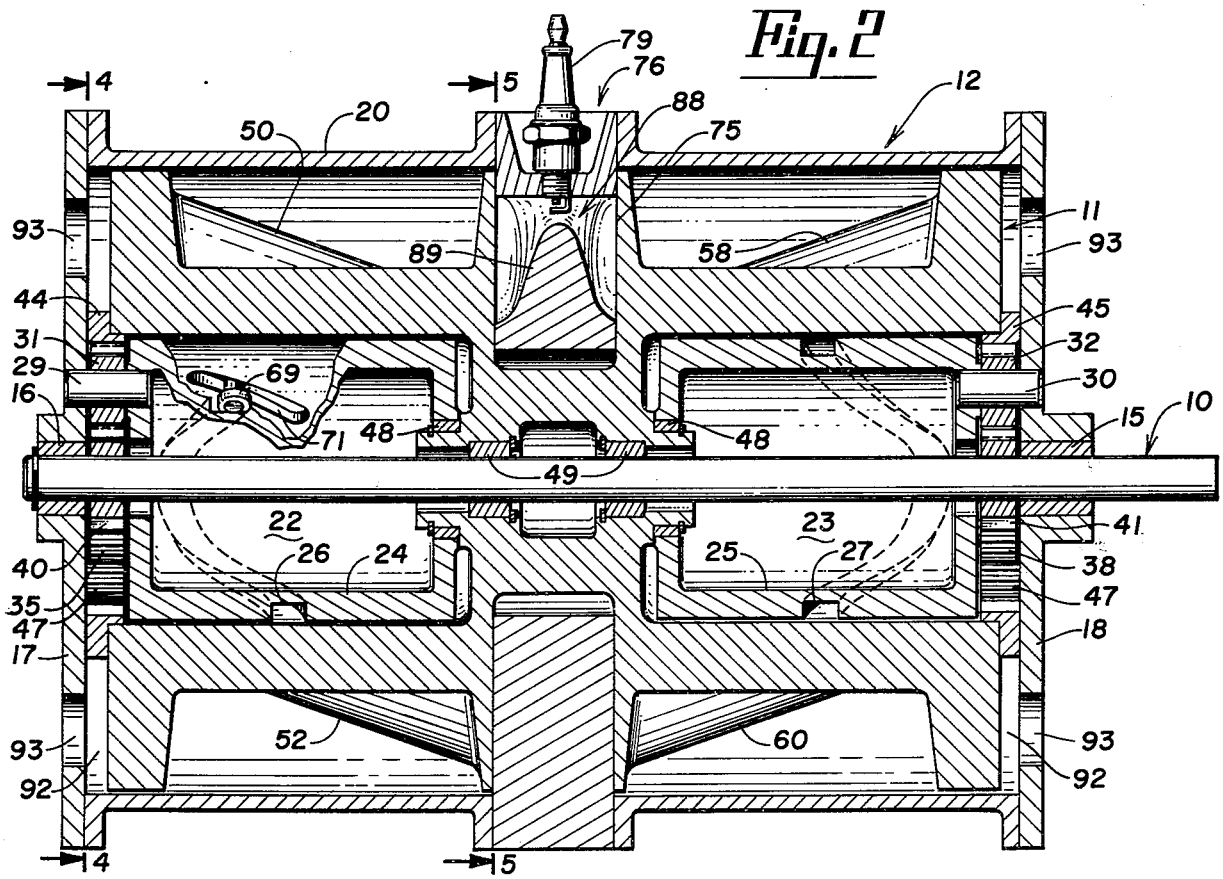
FIG. 2 is a vertical sectional view of the crankless machine.

Referring to the drawing, and particularly to FIG. 2, in which the various elements are shown in section, it will be noted that the machine basically comprises a rotary shaft 10, a rotary cylinder block 11 and a stationary housing 12. All three portions of the engine are concentrically disposed about a common axis. The shaft 10 is journalled in suitable bearings 15 and 16 mounted in opposite end plates 18 and 17, respectively, forming end walls of the housing 12. The housing 12 is provided with a flanged cylindrical member 20 to which the end walls 17 and 18 are suitably secured in any suitable manner, as by welding or any suitable clamping means (not shown).

Figure 4:
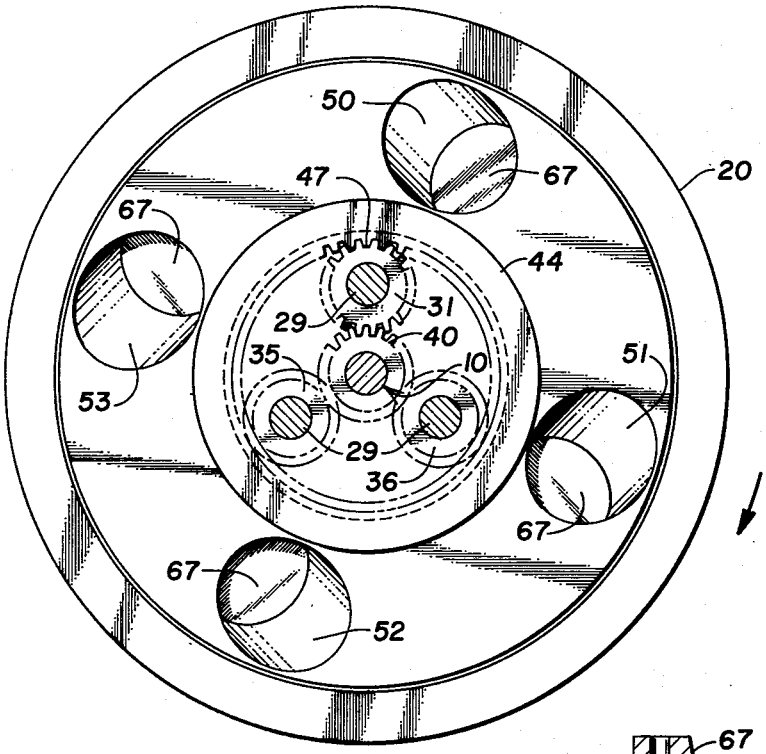
FIG. 4 is a sectional view taken along the line 4—4 of FIG. 2.

Also secured to and forming a part of the stationary housing member are a plurality of drum shaped members 22 and 23 having cylindrical outer walls 24 and 25, respectively, in which are disposed cam grooves 26 and 27 which extend continuously around the outer periphery of the cylindrical walls 24 and 25 of the drum members 22 and 23. The drum shaped member 22 is secured against rotation with respect to the housing member by three pins 29 (FIGS. 2 and 4) and drum member 23 is similarly secured against rotation by three pins 30. Pins 29 and 30 also constitute axles for a number of gears including gears 31 and 32. As shown in FIG. 4, there are three such gears at each end of the machine. These gears are identified in FIG. 4 by the reference numerals 31, 35 and 36, only gears 31 and 35 being visible in FIG. 2. It is also understood that at the opposite end of the engine, there are three gears of which gear 32 is one. A second gear at this end appears in FIG. 2 and is designated by the reference numeral 38. The gears 31, 35 and 36 mesh with a spur gear 40 secured non-rotatably to shaft 10. At the opposite end of shaft 10 a gear 41 secured to the shaft 10 meshes with gears 30, 38 and the third gear, not shown. The axle pins 29 extend through the outer end wall of drum shaped member 22 and the end housing wall 17; similarly, the axle pins 30 extend through the outer end wall of drum shaped member 23 and the end housing wall 18. Thus the axle pins 29 and 30 not only rotatably support the gears secured thereto but they also prevent relative rotation of drum shaped members 22 and 23 so that the latter effectively become portions of the fixed housing.

Secured to opposite ends of the rotary cylinder block 11 are two annular ring members 44 and 45 which have rack teeth 47 (see FIG. 4) formed in the inner wall thereof. These teeth mesh with the various gears carried by pins 29 and 30. For example, referring to FIG. 4, it will be noted that the gears 31, 35 and 36 all are in engagement with the teeth 47 of the annular ring member 44. It will be appreciated from what has been said that the gears 31, 35 and 36 do not shift their position since their axles 29 remain fixed with respect to the housing member. It will thus be readily apparent that any rotation of the rotary cylinder block 11 to which the annular ring 44 is secured will result in rotation of gears 31, 35 and 36 and the resultant rotation of gear 40 secured to shaft 10 to cause rotation of shaft 10. Similarly, at the opposite end of the rotary cylinder block, the rotation of ring 45 secured to the cylinder block will cause rotation of the associated gears surrounding and meshed with gear 41 and cause rotation of gear 41 to in turn cause rotation of shaft 10. Thus, any rotation of the cylinder block causes rotation of the shaft 10. Similarly, if the device is being used as a pump, any rotation of shaft 10 will cause rotation of the cylinder block 11.

Figure 1:
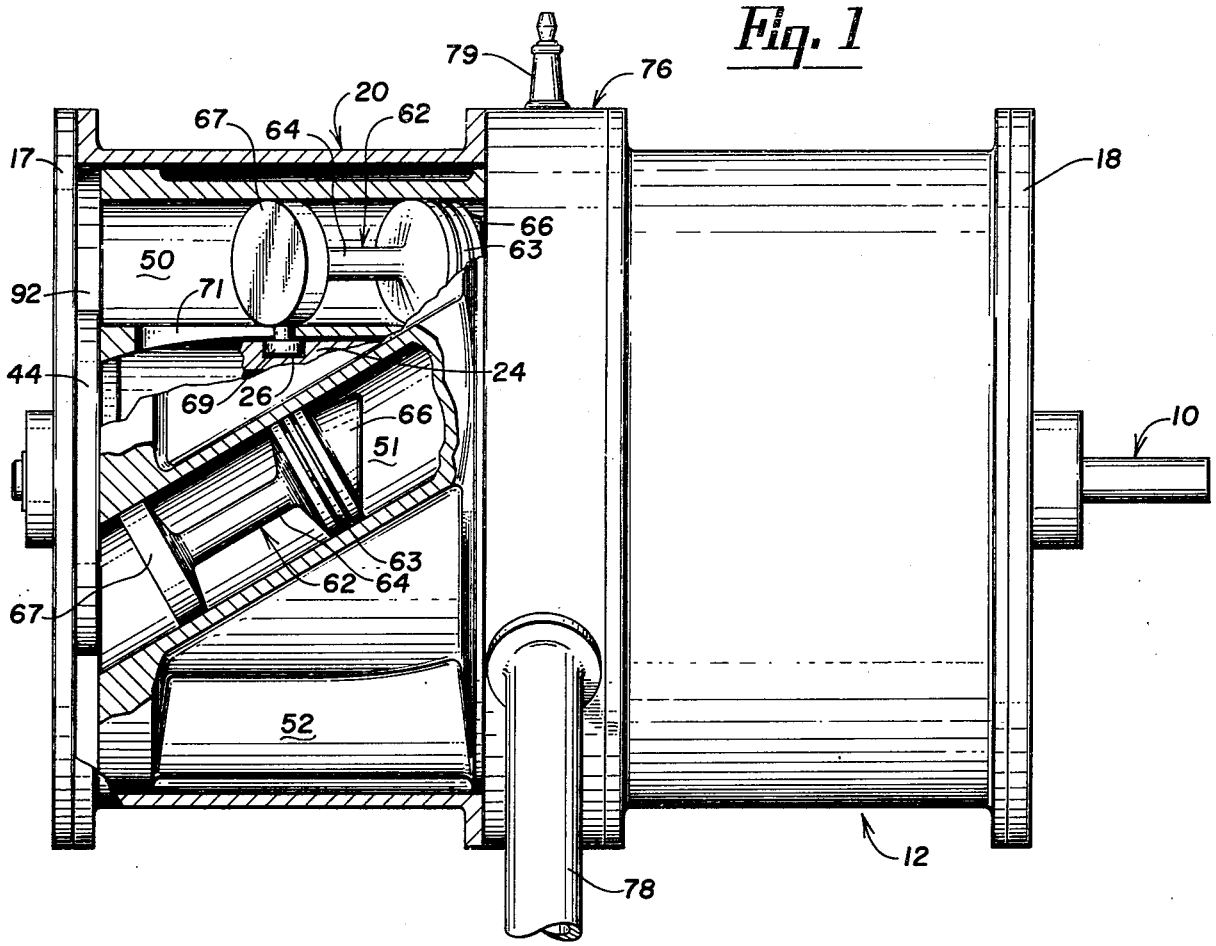
FIG. 1 is an elevational view of the crankless machine with portions on the left hand side cut away on different planes to show two of the cylinders.
Figure 5:
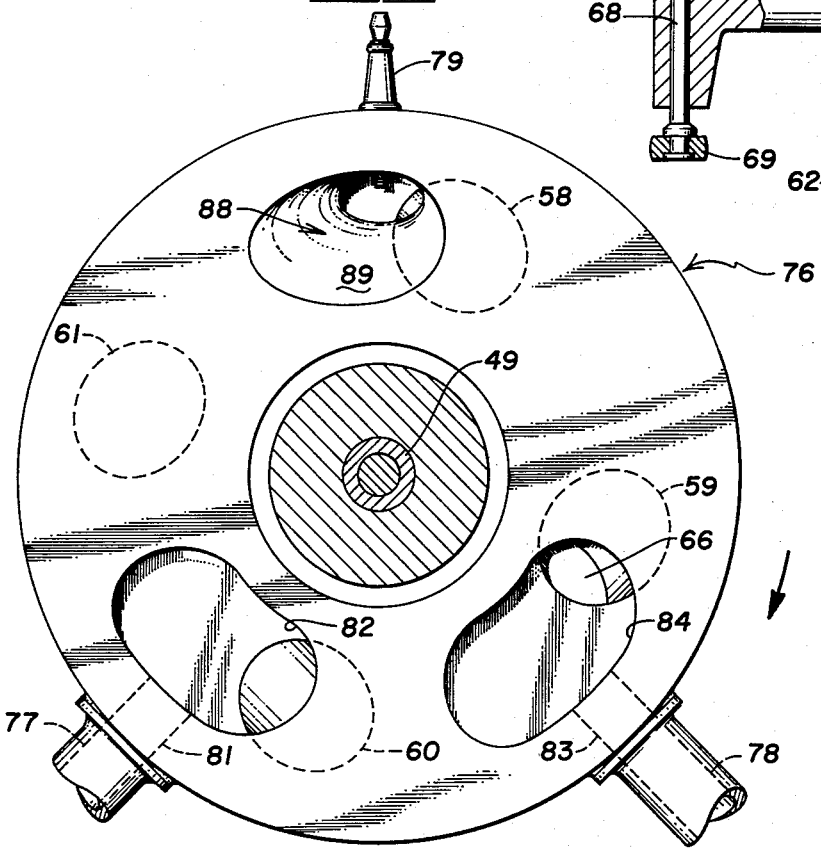
FIG. 5 is a sectional view taken along the line 5—5 of FIG. 2.

The cylinder block 11 is provided with two sets of four cylinders. Referring to FIG. 4, it will be noted that there are four cylinders 50, 51, 52 and 53 which are located on the left hand side of the engine as viewed in FIG. 2. Referring to FIG. 5, it will be noted that there are four cylinders 58, 59, 60 and 61 (shown in dotted lines) which are located on the right hand side of the engine as viewed in FIG. 2. Referring not to FIGS. 1 and 2, it will be noted that in FIG. 1, cylinders 50 and 51 are shown in section whereas in FIG. 2 portions of the exterior walls of cylinders 50, 52, 58 and 60 are shown. As probably best shown in FIG. 2, each of the cylinders is inclined at an angle of approximately 30° with respect to the horizontal axis of the apparatus. Furthermore, each cylinder is inclined with respect to a transverse plane passed through this horizontal axis at an angle of approximately 60°, as best shown in FIG. 1. Each cylinder slopes inwardly towards the axle moving from the outside to the inside. Furthermore, referring to FIG. 1, each cylinder is inclined with respect to a transverse plane through the longitudinal axis is a direction such that the cylinder is inclined towards the direction of rotation of the cylinder block as will be apparent from the subsequent description. The direction of rotation of the cylinder block is indicated by arrows adjacent FIGS. 4 and 5.

Figure 3:
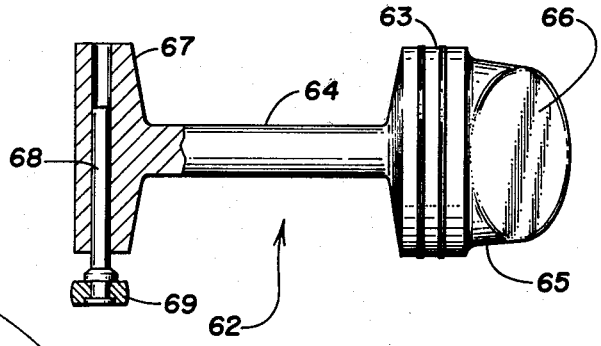
FIG. 3 is an elevational view, partly in section, of one of the pistons.

Located within the cylinders are a plurality of piston assemblies 62. These piston assemblies are all alike. The details of the piston assembly 62 are shown in FIG. 3. It will be noted that there is a piston head 63, with suitable piston rings, secured to a piston shaft 64. The piston head 63 is provided with a cylindrical extension 65 having an inclined face 66. As best shown in FIG. 1, this inclined face is generally parallel to a transverse plane through the horizontal axis. The purpose of this will be discussed later. At the opposite end of the piston shaft 64 is a cylindrical flange 67 which is of substantially the same outside diameter as the piston head 63 and which serves to guide the piston assembly 62 for movement within the cylinder 50, as shown in FIG. 1. The flange 67 has a transverse bore therethrough in which slides a pin 68 having a cam follower roller 69 secured to the outer end thereof. It is understood that each of the piston assemblies is constructed the same way and that each of them has a pin 68 and a cam roller 69. The cam follower roller 69 of each piston assembly 62, as best shown in FIGS. 1 and 2, cooperates with one of the cam grooves 26 and 27 in the two drum shaped members 22 and 23. Each pin 68 extends through a slot 71 in the cylinder wall of the cylinder in which its associated piston assembly is located. The pistons on the left hand side, (as viewed in FIG. 2) all cooperate with the cam groove 26 and the pistons on the right hand side all cooperate with the cam groove 27. It is also to be observed that each cam groove is undulating and progresses periodically from an inner point to an outer point so that any movement, for example, of the rotary cylinder block 11 with respect to the stationary drum members 22 and 23 will cause the pistons 62 to be reciprocated back and forth within their cylinders.

The cylinder block is provided with a central, rather deep annular channel 75 in which is disposed a central annular manifold block 76. The block is disposed adjacent the inner ends of the cylinders and is in sealing sliding engagement with the walls of the channel 75 of the cylinder block. As best shown in FIG. 5, the annular manifold block 76 has connected thereto an inlet pipe 77, an exhaust pipe 78 and, when the device is used as an internal combustion engine, an igniter such as a spark plug 70. The inlet pipe 77 is connected in fluid tight relation to the annular manifold block 76 and communicates through the passage 81 with an opening 82 extending completely through the manifold block and constituting an inlet chamber. As will be pointed out, this inlet chamber is brought successively into communication with the ends of the various cylinders 50, 51, 52, 53, 58, 59, 60 and 61 as the cylinder block rotates. In FIG. 5, the inner end of the cylinder 60 is shown as partially overlapping the intake opening 82. It will be noted that this opening 82 is relatively long circumferentially to allow ample time for the motive fluid, such as a combustible mixture, to be introduced from intake pipe 77 through passage 81, and the inlet passage 82 into the cylinder which is passing by the opening 82.

The exhuast pipe 78 similarly is sealed to the annular manifold block 76 in a fluid tight relationship and is in communication through a cylindrical passage 83 with an exhaust opening 84 which extends through the manifold block so as to be successively in communication with the ends of each of the cylinders of the rotary cylinder block. As shown in FIG. 5, the inner end of cylinder 59 is partially overlapping the opening 84 so that the exhausted motive fluid is just beginning to be exhausted through the exhaust opening 84, passage 83 and exhaust pipe 78. Again, as with intake opening 82, the exhaust opening 84 is relatively long in an arcuate direction so that the exhaust from the cylinder can pass through openings 84, passage 83 and pipe 78 during an appreciable portion of the rotation of the cylinder block.

The spark plug 79 is likewise in communication with an ignition chamber which is best shown in FIG. 2 and is designated by the reference numeral 88. This ignition chamber has a central divider 89 to reduce as much as possible the volume of chamber 88 while still permitting proper ignition of the combustible mixture in the end of the cylinder. Were the divider 89 not present, the chamber 75 would be relatively large and each time that a cylinder came adjacent this ignition chamber, there would be a momentary decrease in the pressure of the gas due to the sudden expansion of the combustion chamber by reason of its communication with ignition chamber 88. It will be noted that the walls of divider 89 are curved in a concave manner to maximize as much as possible the accessibility of the combustible mixture to the gap of the spark plug 79 while, at the same time, decreasing as much as possible the size of the ignition chamber 88.

It will be obvious from the foregoing that as the cylinder block rotates in the direction shown in FIG. 5, the inner ends of the cylinders successively come in contact with the intake opening 82, the ignition chamber 88 and the exhaust opening 84. At the same time, the pistons 62 are moving back and forth. The apparatus is designed so that any one cylinder is adjacent the intake opening 82 at about the time that the cam connection between the drum shaped members 23 and 24 and the pistons has caused piston 62 to start moving outwardly from its innermost position. As it moves outwardly while the piston is moving past the inlet opening 82, motive fluid is introduced into the cylinder. By the time that the cylinder has passed the opening 82, the cylinder has been filled with motive fluid. In the case of an internal combustion engine, a combustible mixture has been drawn into the cylinder under these conditions. By this time, the end of the cylinder is adjacent the solid portion of the manifold member 76 between the inlet opening 82 and the ignition chamber 88 so that the end of the cylinder is closed by the manifold member. At the same time, the cam connections between the drum shaped members 22 and 23 and the cylinder block 11 causes the pistons to move inwardly towards their innermost position. They reach this innermost position just after the ignition chamber 88 is reached. Previously, attention was called to the inclined piston head face 66 on the end of the piston extension 65. The reason for this will now be apparent. Due to the fact that the longitudinal axis of cylinder 51 is inclined with respect to the face of the annular block 76, it would be apparent that normally there would be a substantial space between the head of the piston 63 and the divider 89 within the ignition chamber 88 due to the fact that even if the lower portion of the piston head 63 were moved directly into engagement with the annular block, there would still be a substantial space between the upper portion of the piston and divider 89. By using the piston extension 65 and the inclined face 66 which is parallel with the annular face of the manifold block 76, it is possible to reduce the volume in the combustion chamber when the piston is in a position in which it is desired to ignite the gas.

In this connection, it is noted that the opposite ends of each of the cylinders 50, 51, 52, 53, 58, 59, 60 and 61 is open at its opposite end. The ends of the cylinders communicate with the spaces 92 disposed between the end of the cylinder block and the end plates 17 and 18 of the housing 12. These openings 92 are in communication with the atmosphere through openings 93 in the end plates 17 and 18. The purpose of this it to insure that there is no back pressure on the back side of the pistons. If the outer ends of the pistons were closed, an air cushion would be formed as the piston moved to its outermost position. By reason of the fact that the outer portions of the cylinders are in effect at atmospheric pressure, the pistons 62 can move freely towards their outer position.

OPERATION OF THE MACHINE

The operation of the machine will be described as though it were an internal combustion engine, as shown in the drawing. In such case, it will be initially necessary to rotate shaft 10, as is necessary with starting any internal combustion engine. When this is done, the rotary cylinder block 11 will be rotated with respect to the annular manifold block 76 which is fixed with respect to the stationary housing 12. The rotary cylinder block will move in the direction of the arrows adjacent FIGS. 4 and 5. Thus, considering cylinders 58, 59, 60 and 61, it will be noted, as previously mentioned, that cylinder 60 is approaching a position opposite the intake passage 82 so as to be supplied with a combustible mixture from a carburetor or similar device through intake pipe 77, passage 81, intake opening 82. As also previously explained, the piston under these conditions will be moving outwardly so that the motion of the piston will act to draw in the combustible mixture into the cylinder 60. By the time that the end of the cylinder 60 has passed beyond the opening 82, the piston will have reached the outermost point of its stroke or closely thereto. As the end of the piston passes beyond the opening 82, it is sealed off by engagement with the adjoining wall 75 of the manifold block which at this point is solid and has no openings therethrough. The motion of the piston is now reversed by reason of the cam connection with the drum shaped member 23 and the piston starts moving inwardly. Just shortly before the piston again reaches the innermost point of its movement, it will come into contact with the combustion chamber 88 and the spark plug 79 will be operated to ignite the mixture. As usual, it is desirable that the initial operation of the spark plug takes place just shortly before the piston reaches the innermost point of its stroke so as to allow a slight amount of time for the combustion to extend through the explosive mixture. The resultant combustion of the explosive mixture will force the piston outwardly again, driving the rotary block 76 with respect to the stationary housing 12 and causing rotation of shaft 10.

Still continuing the path of cylinder 60, the end of the cylinder will pass beyond the combustion chamber 88 and again be sealed by reason of the engagement with the manifold block. This will result in the full force of the explosion being applied to cause rotation of the shaft 10. The cam connection between the piston 62 and cylinder 60 and the drum shaped member 23 will cause the piston to reverse its movement at the outer portion of its stroke and start moving backwards. Just as it starts moving backwards, it assumes the position shown in connection with cylinder 59 in FIG. 5. In other words, the inner end of the cylinder will now be exposed to the exhaust opening 84 so that exhaust gas will be forced out of the cylinder through the exhaust opening 84, the passage 83 and the exhaust pipe 78. As the piston moves inwardly, the cylinder will move in the direction shown by the arrow in FIG. 5 so as to progressively expose all of the inner end of the cylinder to the exhaust opening 84. By the time that the cylinder reaches the point where the end of it is no longer adjacent the opening 84, the piston will have moved to its innermost point of its stroke and be ready to reverse and move outwardly. The cylinder will then continue to move until it reaches the position shown in FIG. 5, at which time it is ready to draw in a fresh supply of a combustible mixture.

It will be understood that inasmuch as cylinders 58, 59, 60 and 61 are equally spaced about the rotary cylinder block 11, the same action will take place in connection with each of the other cylinders. For example, the cylinder 59 is shown in a position in which it is just beginning to exhaust the gas. As it continues clockwise, it will eventually reach the position shown for cylinder 60 in FIG. 5 at the same time in the engine cycle as cylinder 60 is in the position shown for cylinder 61. Thus, there is a continuous operation in which the cylinders 58, 59, 60 and 61 are progressively brought into communication with the intake opening 82, the ignition chamber 88 and the exhaust opening 84.

While the operation has been described in connection with cylinders 58, 59, 60 and 61, since the access of these cylinders to the various openings in the manifold block 76 are most clearly visible, it is to be understood that this same action is simultaneously taking place in connection with cylinders 50, 51, 52 and 53. The inner ends of these latter cylinders are not visible in the drawing but it is to be understood that the inner ends, for example, of cylinders 52 and 60 are diametrically opposite each other. Similarly, the inner ends of cylinders 50 and 58 are diametrically opposite to each other. This likewise is true of cylinders 51 and 59 and 53 and 61. Thus, at the same time that cylinder 60 is receiving a combustible mixture, the combustible mixture is also being supplied to cylinder 52. The result is that the engine is very well balanced since firing takes place simultaneously in two cylinders on opposite sides of the center partition. Furthermore, this action occurs four times in each revolution of the rotary cylinder block.

It has been pointed out that the cylinders are so disposed in the cylinder block that they are inclined both with respect to the common axis of the engine and also with respect to a vertical plane passed transversely through this axis. Furthermore, as was also previously pointed out and as is evident from FIG. 1, the angle of inclination is such that it is in the same direction as the direction of rotation. Thus, whatever reactive effect there may be between the pistons 62 and the annular block is such as to tend to cause rotation of the block. In other words, even if there were no cam connection between the pistons 62 and the annular drum shaped members 22 and 23, there would be some tendency for the rotary cylinder housing 11 to rotate to cause rotation of shaft 10. This is further helped by the fact that the opposite cylinders which are firing at the same time are both inclined in the direction of rotation so that the reactive force exerted between the annular block 76 and the rotary cylinder block 11 is one which tends to produce a rotative force from opposite directions. A further advantage of the inclination is that the engine is much more compact longitudinally than would be the case if the cylinders were parallel to the direction of that rotation. In addition, by inclining the cylinders in this direction, the mechanical advantage of the cam arrangement which translates reciprocation of the pistons into rotary movement is much greater. Furthermore, the inclination of the cylinders tends to result in less vibration of the engine.

Another advantage of the present arrangement is that there are no elements extending outwardly beyond the housing so that it would be possible to employ more than one unit to drive a common shaft. In such case, the next unit would abut the unit just described. It would even be possible to employ a half unit in connection with a double unit such as shown. In other words, it would be possible to place on the right hand side of the engine just described a unit corresponding to that on the left hand side of this machine, both operating to drive shaft 10.

The operation has been described in connection with an internal combustion engine in which a combustible mixture is introduced into the cylinder and ignited by a spark plug. Of course, a diesel engine type of operation could be employed just as well. Furthermore, the apparatus is adaptable to an arrangement in which a fluid such as steam would be the motive fluid. In this case, steam would be introduced into the inlet opening 77 and exhausted through the outlet pipe 78. In such case, there would, be no need of the ignition means. Further, while my invention is primarily concerned with an engine, it is also applicable to use for a pump. In such case, the fluid being pumped would be introduced in through the inlet pipe 77 and out through the outlet pipe 78 and the shaft 10 would be driven by some external source of power.

CONCLUSION

It will be seen that I have developed a new rotary crankless machine which is highly efficient, compact and lends itself either to use as an internal combustion engine or an engine employing other motive fluids or to use as a pump.

While I have shown a specific embodiment of my invention, it is to be understood that this is for purposes of illustration only and that the scope of the invention is to be limited solely by the appended claims.

I claim:

1. A rotary crankless machine having a rotary shaft, a rotary cylinder block, and a stationary housing, all concentrically disposed with respect to a common axis, said stationary housing having a central annular manifold block with inlet and outlet passages disposed approximately midway between the ends of said housing and extending inwardly from the outer annular wall of said housing, said annular manifold block having opposite surfaces facing the outer ends of said housing and having two opposed pairs of spaced openings, each of said pairs of openings extending through a different one of said opposite surfaces at a radial distance closer to the outer annular surface of said manifold block than to said common axis, said pairs of openings being connected together in sets, one set of openings communicating with said inlet passage and the other set of openings communicating with said outlet passage, said housing further having means for rotatably coupling together said rotary cylinder block and said shaft so that rotation of either one causes rotation of the other, and said rotary cylinder block comprising two sets of oppositely directed cylinders each of which extends from adjacent an outer wall of said cylinder block inwardly towards said manifold block and through an inner surface of said cylinder block at the same radial distance from said common axis as the openings through the opposite surfaces of said manifold block, said inner surfaces conforming with said opposite surfaces and in sliding, sealing engagement therewith so that the inner ends of said cylinders are selectively brought into communication with said inlet and outlet passages of said manifold block as said cylinder block rotates, each of said cylinders having a longitudinal axis which is substantially inclined inwardly with respect to the common axis of said machine, said cylinder block having a piston disposed in each of said cylinders each of which pistons has a piston head facing said manifold block and movable towards and away from said manifold block as the piston reciprocates within its cylinder, and cam means disposed between said stationary housing and each of said pistons to cause reciprocation of said pistons to result in or accompany rotation of said rotary cylinder block and hence rotation of said rotary shaft.

2. The crankless machine of claim 1 in which the longitudinal axis of each cylinder is not only inclined with respect to the common axes of said machine but is also inclined with respect to any transverse plane perpendicular to said axis.

3. The crankless machine of claim 1 in which the cam means comprises two cylindrical sleeves fixed with respect to said housing and extending concentrically between said rotary cylinder block and said axle, there being one such sleeve for each such set of cylinders, each sleeve having a cam groove therein, and a plurality of cam followers, one for each of said pistons, extending from said pistons into cooperative relation with one of said cam grooves, said cam grooves extending completely around the stationary housing and being of such configuration as to produce the desired relationship between reciprocation of said pistons and rotation of said rotary cylinder block.

4. The rotary crankless machine of claim 1 in which the machine is an engine and in which a motive fluid is introduced into said inlet passage and exhausted from said outlet passage to cause reciprocation of said pistons and hence rotation of said cylinder block and the shaft rotatably coupled thereto.

5. The rotary crankless machine of claim 3 in which the engine is an internal combustion engine and in which the manifold block is provided with means disposed between said inlet and outlet passages for igniting a combustible fuel introduced into said inlet passage and compressed as one or more of said pistons approaches said manifold block.

6. The machine of claim 5 in which the means for igniting the fuel is an electrical spark plug extending through an outer wall of said manifold block.

7. The crankless machine of claim 1 in which the means for coupling said rotary cylinder block and said shaft includes a first gear secured to and concentric with said shaft, an annular rack secured to said rotary cylinder block concentrically with said shaft, and gears carried by an element of said stationary housing and meshing with both said first gear and said rack.

8. The machine of claim 1 in which each set of inwardly directed cylinders consists of four cylinders equally spaced about said cylinder block.

9. The machine of claim 1 in which the rotary cylindrical block has an annular groove extending inwardly from the outer surface thereof and in which said annular manifold block is located in said cylindrical block in seating engagement therewith.

* * * * *